US008242993B2

(12) United States Patent
Chen

(10) Patent No.: US 8,242,993 B2
(45) Date of Patent: Aug. 14, 2012

(54) METHOD OF DRIVING A DISPLAY DEVICE

(75) Inventor: Yu-Yeh Chen, Tainan (TW)

(73) Assignee: Chimei Innolux Corporation (TW)

( * ) Notice: Subject to any disclaimer, the term of this patent is extended or adjusted under 35 U.S.C. 154(b) by 1160 days.

(21) Appl. No.: 12/101,533

(22) Filed: Apr. 11, 2008

(65) Prior Publication Data

US 2008/0252668 A1 Oct. 16, 2008

(30) Foreign Application Priority Data

Apr. 13, 2007 (TW) ..... 96113146 A

(51) Int. Cl.
*G09G 3/36* (2006.01)
*G09G 5/10* (2006.01)

(52) U.S. Cl. ..... 345/89; 345/690

(58) Field of Classification Search ..... 345/92, 345/89, 690
See application file for complete search history.

(56) References Cited

U.S. PATENT DOCUMENTS

| | | | | |
|---|---|---|---|---|
| 7,728,803 | B2 * | 6/2010 | Hu | 345/89 |
| 2005/0146495 | A1 * | 7/2005 | MacKinnon et al. | 345/98 |
| 2006/0209095 | A1 * | 9/2006 | Hsu | 345/690 |
| 2008/0079673 | A1 * | 4/2008 | Liu et al. | 345/87 |
| 2010/0085492 | A1 * | 4/2010 | Shiomi | 345/204 |

FOREIGN PATENT DOCUMENTS

WO WO 2006092977 A1 * 9/2006

* cited by examiner

*Primary Examiner* — Adam J. Snyder
(74) *Attorney, Agent, or Firm* — Trop, Pruner & Hu, P.C.

(57) ABSTRACT

A display device includes a display panel, a timing controller, a data driver and a scan driver. The display panel includes pixels respectively electrically connected to scan lines and data lines. The timing controller calculates the statistic numbers of pixels whose gray level variations between previous and current frames cross the gray-scale level of the gray point according to scan-line-signal refresh times and high-low gray-scale lookup tables, and thus selects one of the scan-line-signal refresh times and one of the lookup tables corresponding to the lowest statistic number. The scan driver outputs scan line signals to the pixels according to the selected scan-line-signal refresh time. The data driver generates pixel data according to the selected lookup table.

16 Claims, 9 Drawing Sheets

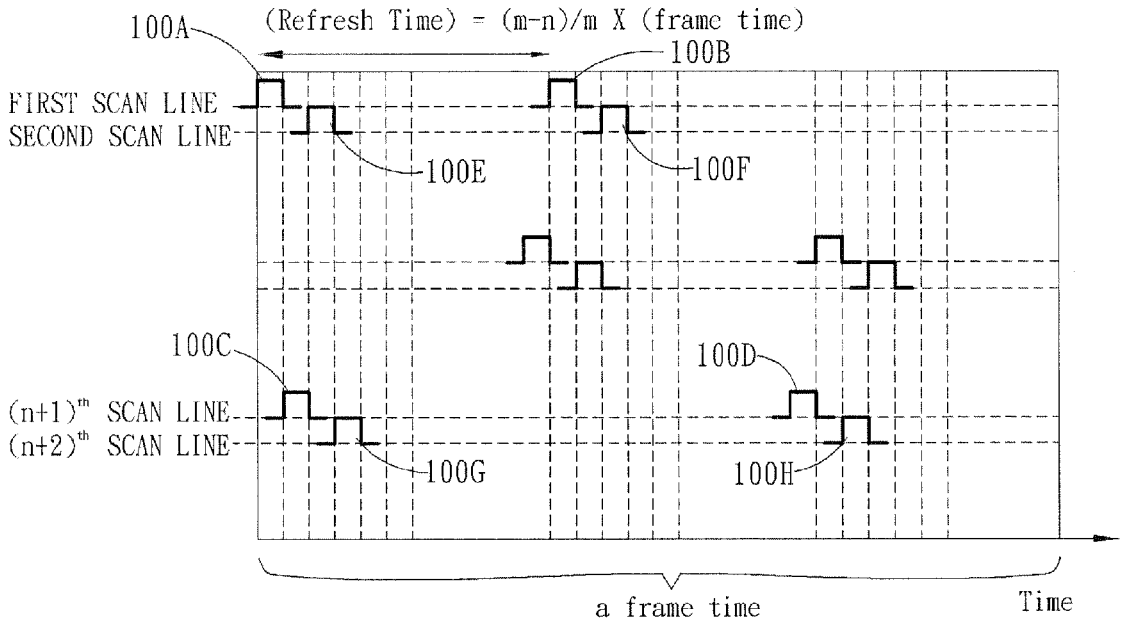
FIG. 3(PRIOR ART)
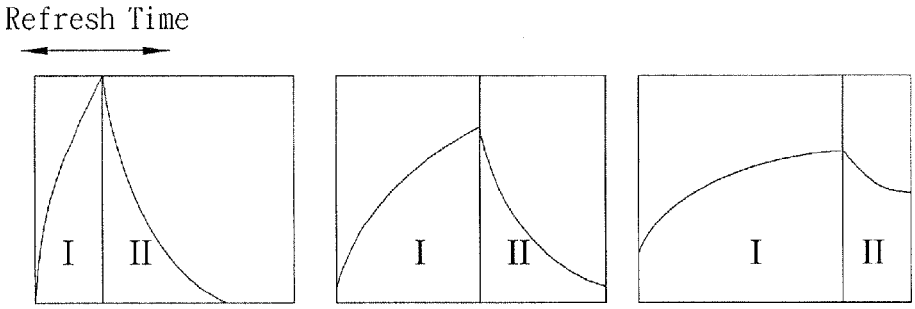
(PRIOR ART) FIG. 4A (PRIOR ART) FIG. 4B (PRIOR ART) FIG. 4C

METHOD OF DRIVING A DISPLAY DEVICE

CROSS-REFERENCE TO RELATED APPLICATION

This claims priority under 35 U.S.C. §119 of Taiwan Patent Application No. 96113146, filed Apr. 13, 2007, which is hereby incorporated by reference.

TECHNICAL FIELD

The invention relates to a method of driving a liquid crystal display device and, in particular, to a liquid crystal display device capable of displaying motion pictures with an improved quality, and a method of driving the liquid crystal display device.

BACKGROUND

A typical conventional liquid crystal display (LCD) device is a hold-type display device (also referred to as "sample-and-hold-type" display device), in which pixels of an image are held (or kept constant) for the duration of a frame time period. In one example, the hold time can be a vertical period of 16.7 ms (milliseconds). Recently, with large scale LCD panels used with personal computers (PCs) or televisions (TVs), increased emphasis has been placed on improving the display quality of a motion picture by the LCD panel. Blurring of displayed images of a motion picture is due to a blurred edge profile occurring when a frame is being switched. There are two causes of a blurred motion picture. One is the response time of the liquid crystal, and the other is the active matrix liquid crystal driving method that involves use of TFTs (thin-film transistors).

In general, the response time of the liquid crystal is important to the motion picture display quality. The switching time of the one frame is typically about 16.7 ms in LCD panels used in TVs. Therefore, whether or not a liquid crystal layer used in a TV LCD panel can achieve a response time of 16.7 ms or less is a factor in determining whether blurring will occur.

However, nevertheless, even if the response time of the liquid crystal layer is 0 ms, blurring may still occur because a typical LCD device displays an image in the hold-type manner.

FIG. 1 is a graph showing a motion picture response time versus a previous gray level and a current gray level. As shown in FIG. 1, the pixels in area A are the ones switched from a low gray-scale level in the previous frame to a high gray-scale level in the current frame, and the pixels in area B are the ones switched from a high gray-scale level in the previous frame to a low gray-scale level in the current frame. The response time of each pixel in either the area A or the area B is longer, so the quality of the motion picture in areas A and B is relatively poor and the blur phenomenon may occur.

Conventionally, the blur phenomenon of a motion picture caused by a hold time may be improved by using dynamic scanning backlight, in which the backlight source is turned on and off according to the frame frequency and phase, and by using an intermittent display method with black signal insertion. Generally, the intermittent display method with black signal insertion involves synthesizing a gray-scale level by successively displaying one high gray-scale level and one low gray-scale level. Thus, a gray-scale lookup table (or High-Low Lookup Table or LUT) may be disposed in the display system. For a given input gray-scale level (that is to be displayed), the lookup table is accessed to obtain the corresponding high gray-scale level and the corresponding low gray-scale level, which are used to successively drive a pixel in a single frame.

FIG. 2 is a graph showing four different areas depending on a previous gray level versus a current gray-scale level. As shown in FIG. 2, when the gray-scale level of a pixel is represented with 8 bits, the range of gray-scale level is from 0 to 255. The gray-scale level of a given gray point (GP) may be defined by successively displaying a full white gray-scale level (255) and a full black gray-scale level (0), so that the gray-scale level of the point (GP) can be synthesized and displayed in a dynamically stable condition and determined according to the property of the liquid crystal. In other words, voltages corresponding to the gray-scale levels 0 and 255 may be input to the display panel using two pulse signals so that the gray-scale level of the point GP may be obtained.

As shown in FIG. 2, the previous frame has a gray point GP for a particular pixel, and the current frame has another gray point GP for the particular pixel. In the chart of FIG. 2, the gray point GP of the previous frame is associated with a horizontal line, and the graph point GP of the current frame is associated with a vertical line. The horizontal and vertical lines that intersect the two gray points define four areas: a first area, a second area, a third area and a fourth area. If a pixel with the low gray-scale level in the previous frame is switched to a high gray-scale level in the current frame (as in the second area), or the pixel with the high gray-scale level in the previous frame is switched to a low gray-scale level in the current frame (as in the third area), the gray-scale level variation of the pixel in either the second area or the third area crosses the lines in the chart corresponding to the gray points GP. The quality of the motion picture of pixels that exhibit such gray-scale variations of FIG. 2 can be poor.

FIG. 3 is a timing diagram showing timings for displaying one gray-scale pulse signal in a synthesized manner by successively displaying the high gray-scale level and the low gray-scale level, wherein m is the number of scan lines in a display device. Each scan line is turned on at least twice (with two corresponding pulses 100A and 100B) in one frame time, and the time interval between the two successive turn-on pulses 100A and 100B is defined as a refresh time. Each pulse in FIG. 3 is a voltage signal of a scan line. A signal corresponding to a low gray-scale level is provided on a scan line during a first refresh time (pulse 100A), while a signal corresponding to a high gray-scale level is provided on the scan line during a second refresh time (pulse 100B). Alternatively, a signal corresponding to a high gray-scale level may be provided in the scan line during the first refresh time, while a signal corresponding to a low gray-scale level is provided on the scan line during the second refresh time. Additionally, scan lines may be turned on in the following order. The first scan line is first turned on (pulses 100A and 100B). Next, the $(n+1)^{th}$ scan line is turned on (pulses 100C and 100D). Then, the second scan line is turned on (pulses 100E and 100F). Next, the $(n+2)^{th}$ scan line is turned on (100G and 100H), and so forth, until all the scan lines have been turned on. Thereafter, for the next frame, the scan lines are again turned on according to the above-mentioned order. Thus, it is possible to derive a refresh time as equal to $(m-n/m)\times$one frame time, where the refresh time can be dynamically changed by adjusting the value of n.

FIGS. 4A to 4C are schematic illustrations showing that the gray point position (gray-scale level) is changed by controlling the time for successively displaying the high gray-scale level and the low gray-scale level from the same gray-scale lookup table (High-Low LUT), as conventionally done. That is, the gray point position (gray-scale level) may be changed by controlling the widths of the applied pulse signals by reference to the high gray-scale level lookup table (High LUT) and the low gray-scale level lookup table (Low LUT).

As shown in FIG. 4A, the time for displaying the high gray-scale level is controlled to be shorter (see the I area) while the time of displaying the low gray-scale level is controlled to be longer (see the II area). In other words, the driving time corresponding to the high LUT is controlled to be shorter, and the driving time corresponding to the low LUT is controlled to be longer. Thus, the gray point position (gray-scale level) may be adjusted in the direction toward the lower gray-scale level. As shown in FIG. 4B, the time of displaying the high gray-scale level (see the I area) and the time of displaying the low gray-scale level are controlled to be the same. In other words, the driving time corresponding to the high LUT and the driving time corresponding to the low LUT are controlled to be the same. As shown in FIG. 4C, the time of displaying the high gray-scale level is controlled to be longer (see the I area) and the time of displaying the low gray-scale level is controlled to be shorter (see the II area). In other words, the driving time corresponding to the high LUT is controlled to be longer, and the driving time corresponding to the low LUT is controlled to be shorter. Thus, the gray point position (gray-scale level) may be adjusted in the direction toward the higher gray-scale level.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 3 is a timing diagram showing timings of gray-scale pulse signals provided in a synthesized manner by intermittently displaying a high gray-scale level and a low gray-scale level;

FIGS. 4A to 4C are schematic illustrations showing that the gray point position (gray-scale level) can be changed by controlling the time for intermittently displaying the high gray-scale level and the low gray-scale level as conventionally performed;

DETAILED DESCRIPTION

In accordance with some embodiments, a liquid crystal display (LCD) device includes a driving mechanism for improving the display quality of a motion picture. A statistic number of each gray point is determined by counting the number of pixels whose gray level variations between a previous frame and a current frame (two successive frames) cross the gray-scale level of the gray point. When a minimum statistic number is found, then that indicates that the best gray-scale lookup table (High-Low LUT) and its corresponding display time have been determined.

Figure 9:
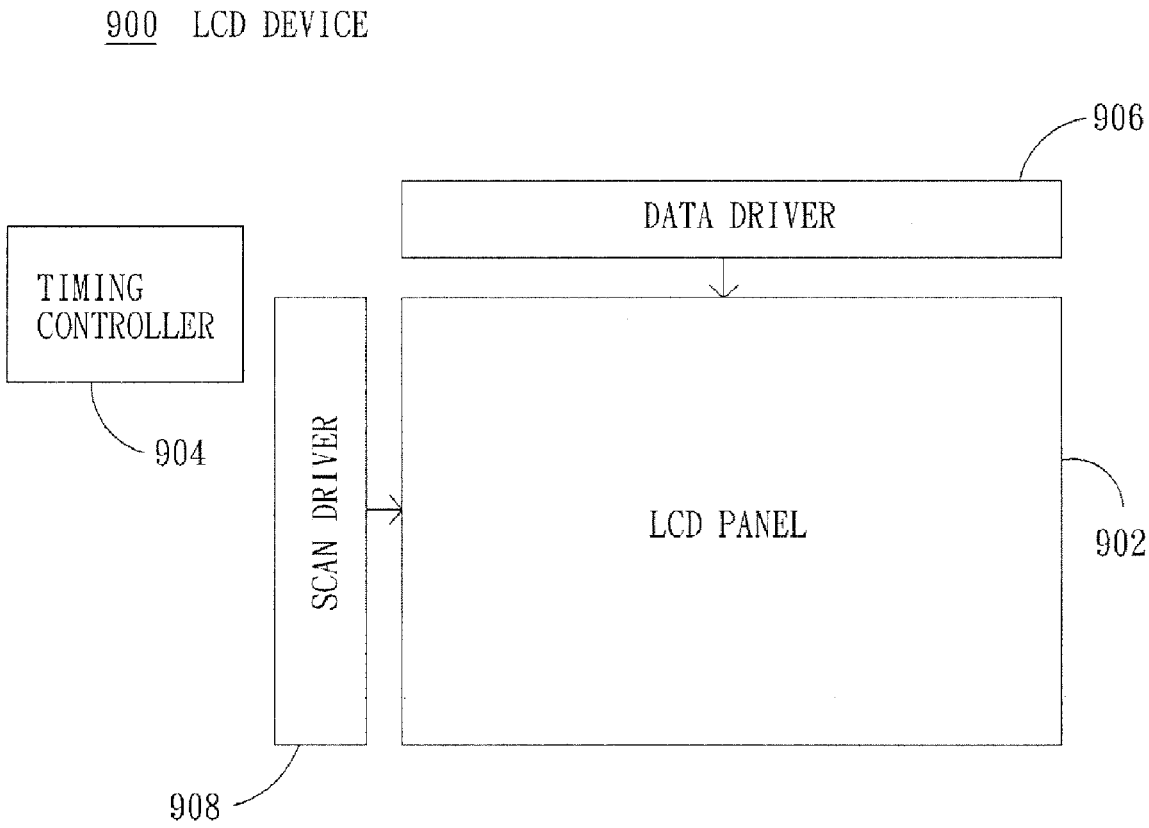
FIG. 9 is a block diagram of an example LCD device in which an embodiment of the invention can be incorporated.

As depicted in FIG. 9, an LCD device 900 according to some embodiments includes a display panel 902, a timing controller 904, a data driver 906, and a scan driver 908. The display panel 902 includes a plurality of pixels, which are respectively electrically connected to scan lines and data lines, and generates a predetermined luminance in a frame. The timing controller 904 calculates statistic numbers of each gray point by counting the number of the pixels whose gray level variations between a previous frame and current frame (two successive frames) cross the gray level of the gray point according to at least one scan-line-signal refresh time and at least one gray-scale lookup table. Each of multiple different gray-scale lookup tables is associated with a gray point (that is determined by successively displaying a full white gray-scale level and a full black gray-scale level in a frame). As further noted above, the gray point is determined by the amount of time (refresh time) that a pixel is driven to the high gray-scale level versus the amount of time that the pixel is driven to the low gray-scale level. From the foregoing, the gray-scale lookup table corresponding to the least statistic number is identified. The data driver 906 generates over-drive pixel data according to the gray-scale lookup table corresponding to the least statistic number so as to output driving voltages of the over-driven pixel data to the pixels through the data lines. Over-driven pixel data refers to pixel data in which a voltage of the pixel data is driven to greater than a target voltage corresponding to the gray-scale level to be displayed to improve liquid crystal response. In other implementations, over-driving of pixels does not have to be used. The scan driver 908 outputs scan line signals to the pixels according to the scan-line-signal refresh time corresponding to the least statistic number so as to enable the pixels to receive the driving voltages of the over-driven pixel data.

FIGS. 5A to 5D are schematic illustrations showing that the gray point position (gray-scale level) can be changed using different example gray-scale lookup tables (or High-Low Lookup Tables or LUTs) to control the time periods of successively displaying the high gray-scale level and the low gray-scale level when the scan-line-signal refresh time is not changed according to some embodiments of the invention.

Figure 1:
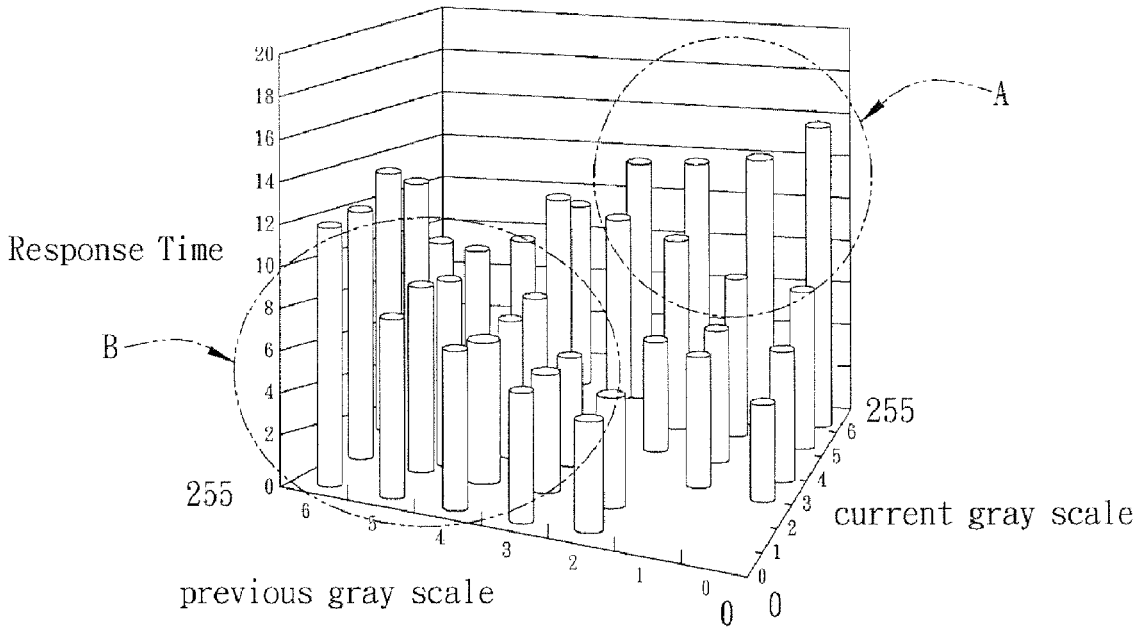
FIG. 1(PRIOR ART)
FIG. 1 is a graph that shows response time versus a previous gray-scale level and a current gray-scale level.
Figure 2:
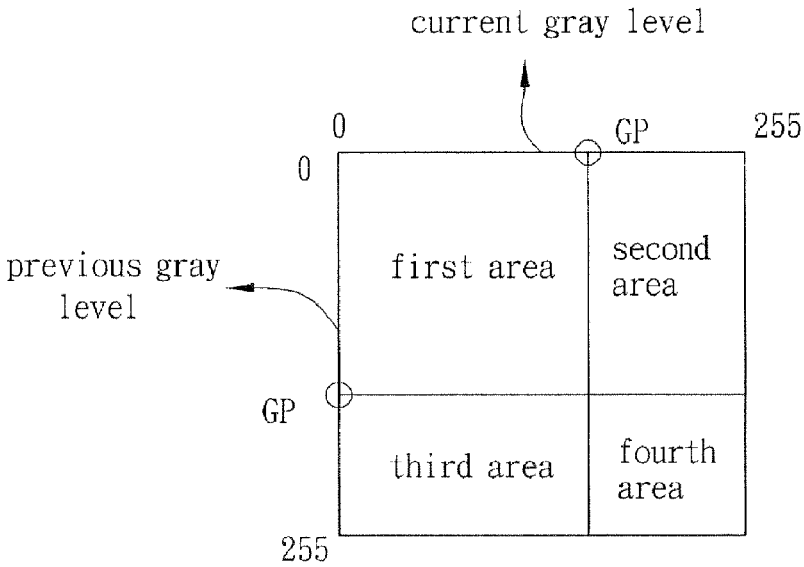
FIG. 2(PRIOR ART)
FIG. 2 is a graph showing four areas depending on a previous gray-scale level versus a current gray-scale level.
Figure 5A:
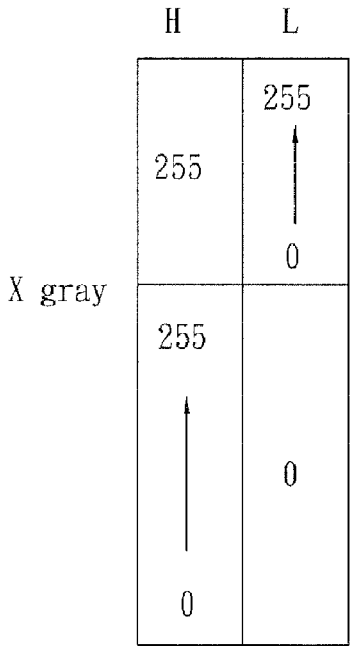
FIGS. 5A to 5D are schematic illustrations showing that the gray point position (gray-scale level) is changed using different gray-scale lookup tables (or High-Low Lookup Tables, High-Low LUTs) when the scan-line-signal refresh time is not changed, according to an embodiment of the invention.
Figure 5B:
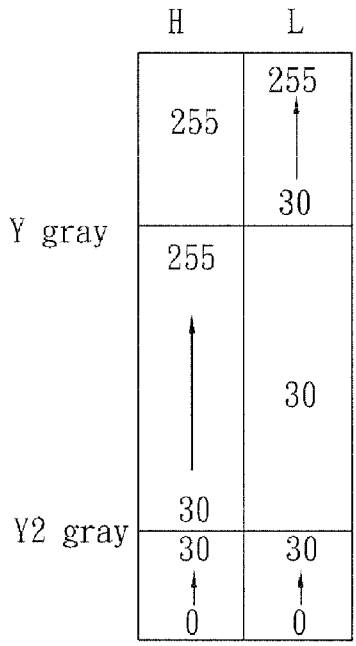
Figure 5C:
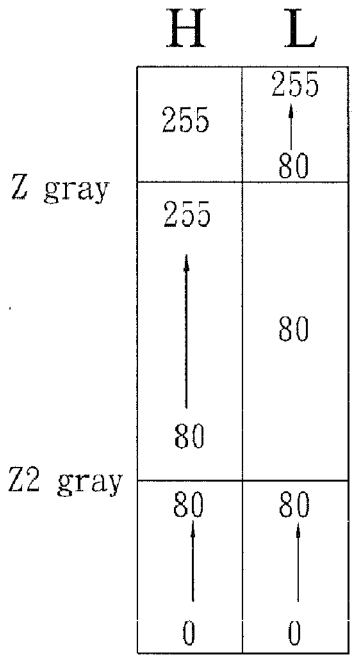

FIG. 5A shows a gray-scale lookup table (High-Low LUT), wherein the X gray-scale level represents the gray point position (gray point X corresponds to gray-scale level 255 in the high LUT, and gray point X corresponds to 0 in the low LUT). As shown in FIG. 5B, the high gray-scale level lookup table (High LUT) varies from the gray-scale level of 0 to the gray-scale level of 30, and then from the gray-scale level of 30 (corresponding to gray point Y2) to the gray-scale level of 255. The low gray-scale level lookup table (Low LUT) varies from the gray-scale level of 0 to the gray-scale level of 30, and then from the gray-scale level of 30 to the gray-scale level of 255. The difference between FIG. 5A and FIG. 5B is that no high or low gray-scale level variation is generated according to FIG. 5B if the input signal is lower than the gray-scale level of 30. That is, the high and low gray-scale levels are both equal to the input signal when the input signal is lower than the gray-scale level of 30, if the lookup table of FIG. 5B is used. In addition, FIG. 5B shows two gray points "Y gray" and "Y2 gray". As shown in FIG. 5C, the high gray-scale level lookup table (High LUT) varies from the gray-scale level of 0 to the gray-scale level of 80 (which corresponds to Z2 gray point), and then from the gray-scale level of 80 to the gray-scale level of 255 (which corresponds to the Z gray point). The low gray-scale level lookup table (Low LUT) varies from the gray-scale level of 0 to the gray-scale level of 80 (Z2 gray point), and then from the gray-scale level of 80 to the gray-scale level of 255 (Z gray point). The difference between FIG. 5A and FIG. 5C is that no high or low gray-scale level variation is generated in FIG. 5C if the input signal is lower than the gray-scale level of 80 and the input signal is not changed. In addition, FIG. 5C shows two gray points "Z gray" and "Z2 gray".

Figure 5D:
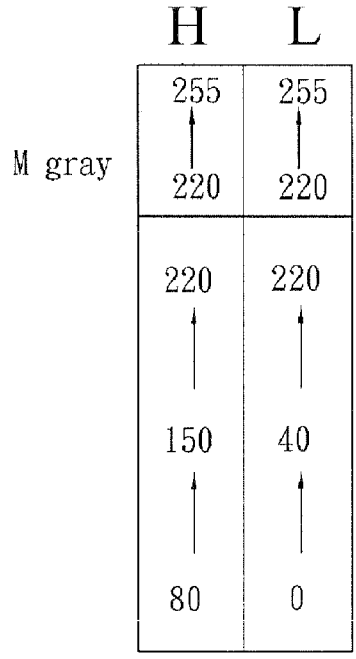
Figure 6A:
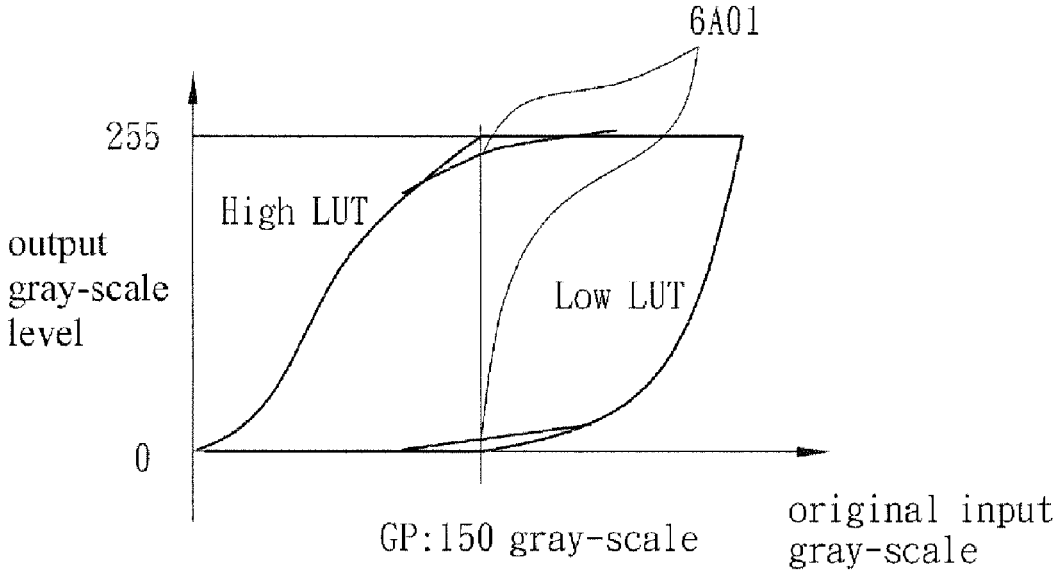
FIGS. 6A to 6D are schematic illustrations showing the relationship between the original input gray-scale, the output gray-scale level and the gray-scale lookup table (High-Low LUT) corresponding to FIGS. 5A to 5D.
Figure 6B:
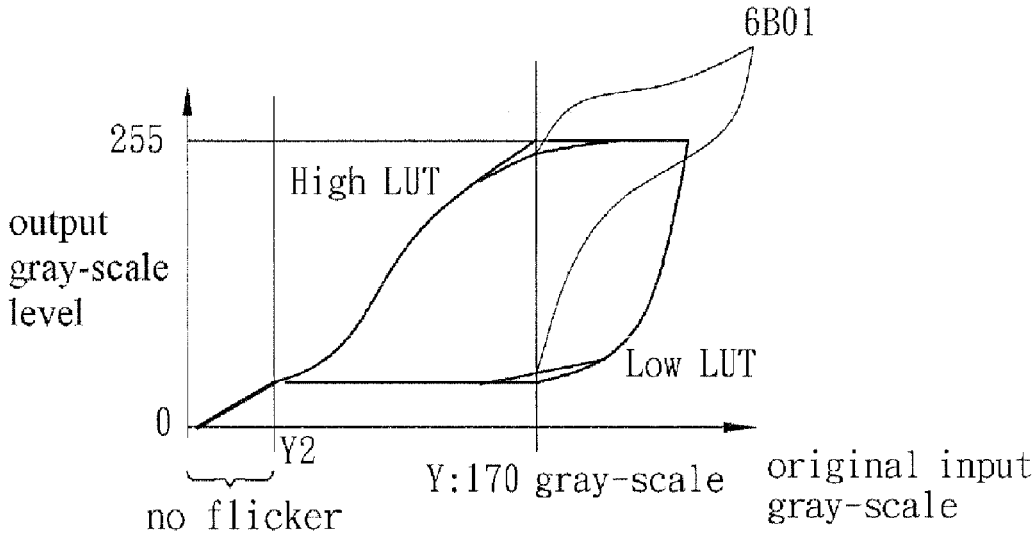
Figure 6C:
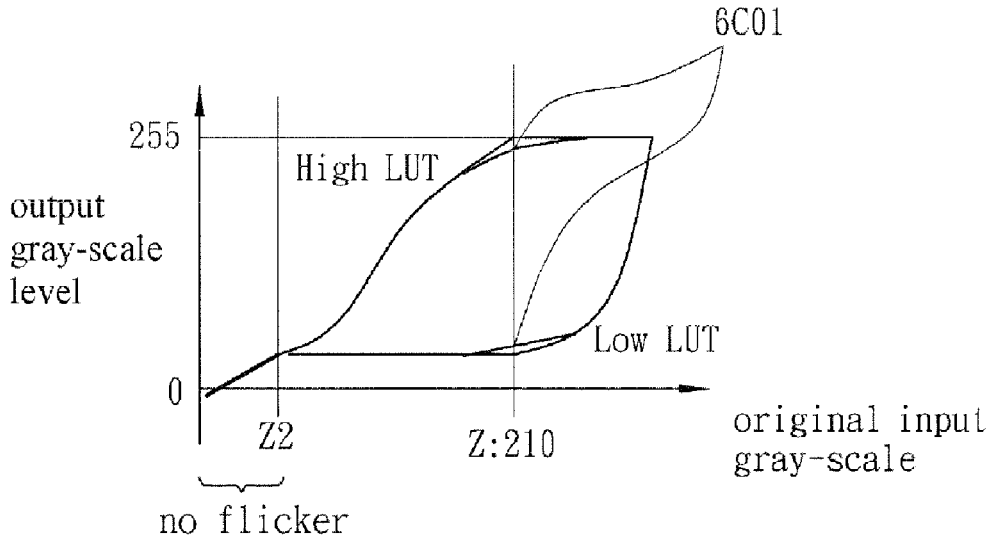
Figure 6D:
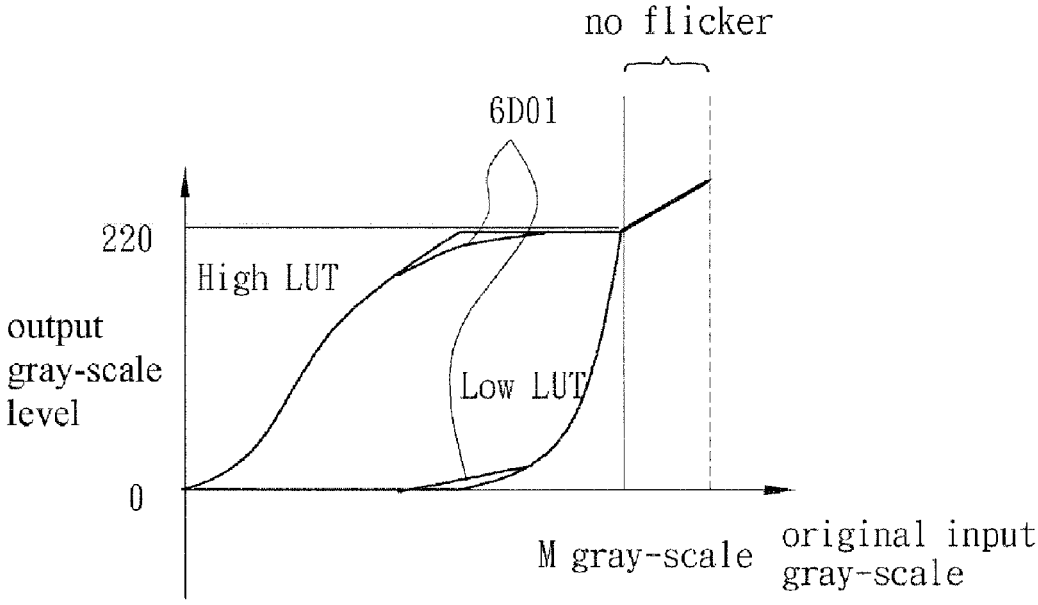

As shown in FIG. 5D, the high gray-scale level lookup table (High LUT) varies from the gray-scale level of 80 to the gray-scale level of 150, from the gray-scale level of 150 to the gray-scale level of 220 (M gray point), and finally from the gray-scale level of 220 to the gray-scale level of 255. The low gray-scale level lookup table (Low LUT) varies from the gray-scale level of 0 to the gray-scale level of 40, from the gray-scale level of 40 to the gray-scale level of 220, and finally from the gray-scale level of 220 to the gray-scale level of 255. The difference between FIG. 5D and the above-mentioned drawings is that no high or low gray-scale level variation is generated in FIG. 5D if the input signal is higher than the gray-scale level of 220. That is, the high and low gray-scale levels are both equal to the input signal when the input signal is higher than the gray-scale level of 220. In addition, FIG. 5D has one gray point "M gray". A portion of the gray-scale data in the high LUT and a portion of the gray-scale data in the low LUT are the same in order to change the gray point position and to decrease the frame flicker in the stationary background.

FIGS. 6A to 6D are schematic illustrations showing the relationship between the original input gray-scale level, the output gray-scale level, and the gray-scale lookup table (High-Low LUT) corresponding to FIGS. 5A to 5D. In addition, the portions of the curves of FIGS. 6A to 6D, which are not gradual, may be dynamically and slightly adjusted in order to decrease the discontinuous display of some gray-scale levels when viewing from the side of the frame. That is, the corresponding gray-scale lookup tables (High-Low LUTs) in FIGS. 5A to 5D may be dynamically and slightly adjusted. Then, the smooth curves 6A01, 6B01, 6C01 and 6D01 may be obtained.

FIGS. 7A to 7D are schematic illustrations showing the LCD device and the driving method thereof for improving the display quality of the motion picture according to an embodiment of the invention.

Figure 7A:
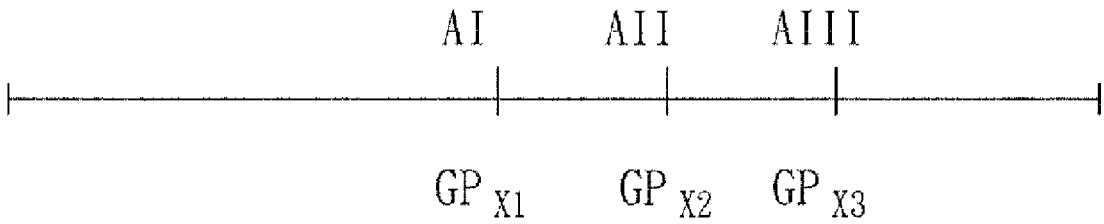
FIGS. 7A to 7D are schematic illustrations showing gray points generated according to the driving time of the high-low lookup table in conjunction with the gray-scale lookup table according to an embodiment of the invention.

As shown in FIGS. 4A, 5A and 7A, the driving time for driving the high gray-scale level obtained from the high LUT is shorter, and the driving time for driving the low gray-scale level obtained from the low LUT is longer as shown in FIG. 4A. Also, a gray point $GP_{X1}$ is generated based on a combination of the refresh time of FIG. 4A and the gray-scale lookup table (High-Low LUT) of FIG. 5A. Similarly, as shown in FIGS. 4B, 5A and 7A, the driving time for driving the high gray-scale level obtained from the high LUT is the same as the driving time for driving the low gray-scale level obtained from the low LUT as shown in FIG. 4B. Also, a gray point $GP_{X2}$ is generated based on the combination of the refresh time of FIG. 4B with the gray-scale lookup table (High-Low LUT) of FIG. 5A. Also, as shown in FIGS. 4C, 5A and 7A, the driving time for driving the high gray-scale level obtained from the high LUT is longer, and the driving time for driving the low gray-scale level obtained from the low LUT is shorter as shown in FIG. 4C. A gray point $GP_{X3}$ is generated after combining the refresh time of FIG. 4C with the gray-scale lookup table (High-Low LUT) of FIG. 5A.

Figure 7B:
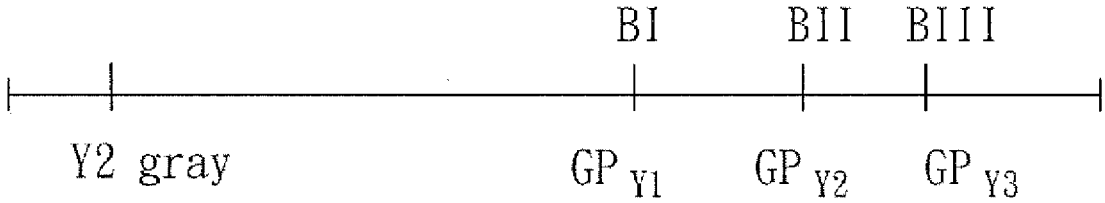

As shown in FIGS. 4A, 5B and 7B, the driving time for driving the high gray-scale level obtained from the high LUT is shorter, and the driving time for driving the low gray-scale level obtained from the low LUT is longer as shown in FIG. 4A. A gray point $GP_{Y1}$ is generated after combining the refresh time of FIG. 4A with the gray-scale lookup table (High-Low LUT) of FIG. 5B. Similarly, as shown in FIGS. 4B, 5B and 7B, the driving time for driving the high gray-scale level obtained from the high LUT is the same as the driving time for driving the low gray-scale level obtained from the low LUT as shown in FIG. 4B. A gray point $GP_{Y2}$ is generated after combining the refresh time of FIG. 4B with the gray-scale lookup table (High-Low LUT) of FIG. 5B. As shown in FIGS. 4C, 5B and 7B, the driving time for driving the high gray-scale level obtained from the high LUT is longer, and the driving time for driving the low gray-scale level obtained from the low LUT is short as shown in FIG. 4C. A gray point $GP_{Y3}$ is generated after combining the refresh time of FIG. 4C with the gray-scale lookup table (High-Low LUT) of FIG. 5C. The gray point $Y_2$ is the gray point generated according to FIG. 5B.

Figure 7C:
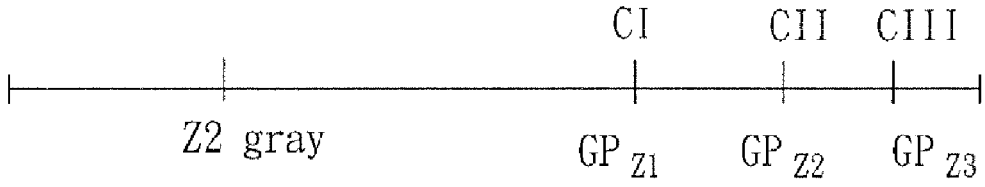
Figure 7D:
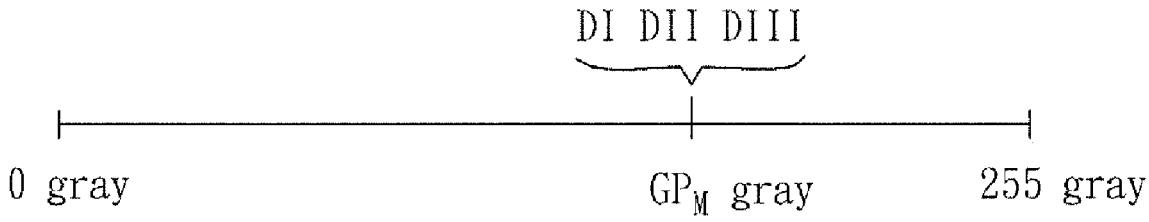

As shown in FIGS. 4A, 5C and 7C, the driving time for driving the high gray-scale level obtained from the high LUT is shorter, and the driving time for driving the low gray-scale level obtained from the low LUT is longer as shown in FIG. 4A. A gray point $GP_{Z1}$ in FIG. 7C is generated after combining the refresh time of FIG. 4A with the gray-scale lookup table (High-Low LUT) of FIG. 5C. Similarly, as shown in FIGS. 4B, 5C and 7C, the driving time for driving the high gray-scale level obtained from the high LUT is the same as the driving time for driving the low gray-scale level obtained from the low LUT as shown in FIG. 4B. A gray point $GP_{Z2}$ is generated after combining the refresh time of FIG. 4B with the gray-scale lookup table (High-Low LUT) of FIG. 5C. As shown in FIGS. 4C, 5C and 7C, the driving time for driving the high gray-scale level obtained from the high LUT is longer, and the driving time for driving the low gray-scale level obtained from the low LUT is shorter as shown in FIG. 4C. A gray point $GP_{Z3}$ in FIG. 7C is generated after combining the refresh time of FIG. 4C with the gray-scale lookup table (High-Low LUT) of FIG. 5C. The gray point $Z_2$ gray is the gray point generated according to FIG. 5C.

As shown in FIGS. 4A, 4B, 4C, 5D and 7D, the gray-scale breakpoints in the high LUT and the low LUT of FIG. 5D both lie on the gray-scale level of 220, so the gray point does not vary even if the scan-line-signal refresh time changes. Thus, only one gray point "$GP_M$ gray" is generated.

Figure 8:
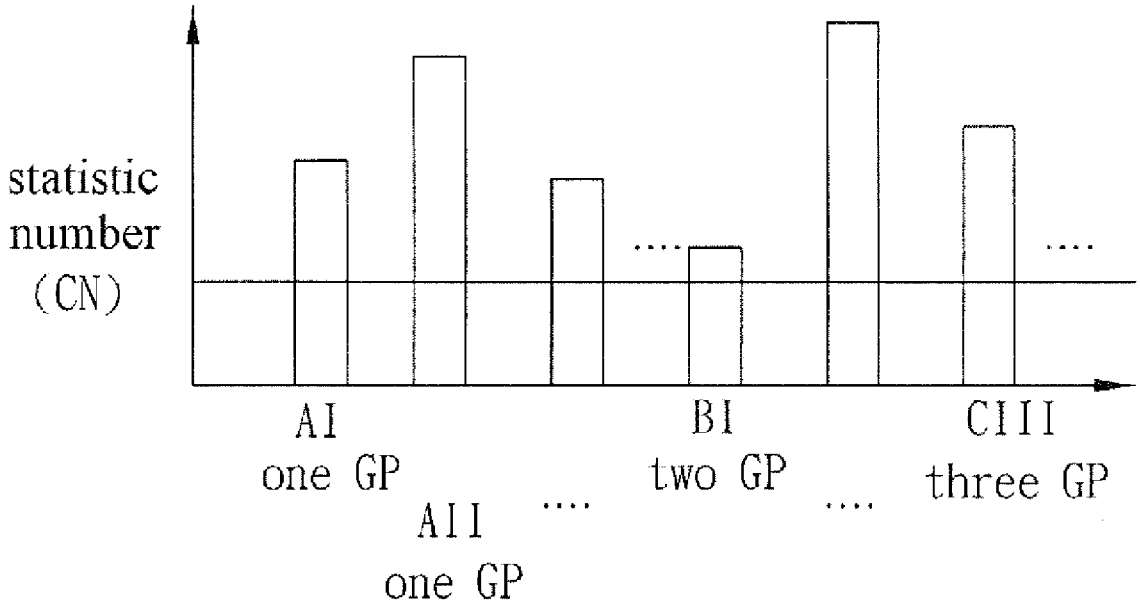
FIG. 8 is a schematic illustration showing the statistic numbers of pixels whose gray level variations between two successive frames cross the gray level of a gray point according to an embodiment of the invention.

FIG. 8 is a schematic illustration showing the statistic numbers of each gray point, and the statistic number means the number of pixels whose gray-scale level variations between a previous frame and a current frame cross the corresponding gray points according to the preferred embodiment of the invention. The algorithm will be described as follows. Take BI in FIG. 8 for example, gray point $Y_2$ is determined when the gray-scale lookup table of FIG. 5B is selected, and gray point $GP_{Y1}$ is then determined when the scan-line-signal refresh time is selected. Therefore, the statistic number of gray point $GP_{Y1}$ includes the statistic number of gray point $Y_2$.

If $G_{n-1}(i, j)$ is smaller than $GP_x$ and $G_n(i, j)$ is greater than $GP_x$ or $G_{n-1}(i, j)$ is greater than $GP_x$ and $G_n(i, j)$ is smaller than $GP_x$, wherein gray point $GP_x$ may be $GP_{X1}$, $GP_{X2}$, $GP_{X3}$, $GP_{Y1}$, $GP_{Y2}$, $GP_{Y3}$, $Y_2$ gray, $GP_{Z1}$, $GP_{Z2}$, $GP_{Z3}$ or $Z_2$ gray, then the statistic number $CN_x$ is gradually accumulated with increments of 1, wherein $G_n(i, j)$ represents the gray-scale level of the pixel in the $i^{th}$ row and the $j^{th}$ column in a certain frame. That is, when the gray-scale level $G_{n-1}(i, j)$ of the pixel in the $i^{th}$ row and the $j^{th}$ column in the previous frame is smaller than the gray-scale level of the gray point $GP_x$ and the gray-scale level of the pixel in the $i^{th}$ row and the $j^{th}$ column in the current frame $G_n(i, j)$ is greater than the gray-scale level of the gray point $GP_x$, or when the gray-scale level $G_{n-1}(i, j)$ of the pixel in the $i^{th}$ row and the $j^{th}$ column in the previous frame is greater than the gray-scale level of the gray point and the gray-scale level of the pixel in the $i^{th}$ row and the $j^{th}$ column in the current frame is smaller than the gray-scale level of the gray point, the statistic number $CN_x$ of gray point $GP_x$ is gradually accumulated with an increment of 1. Thus, the schematic illustration of FIG. 8 shows the statistic numbers of pixels whose gray level variations between the previous frame and the current frame cross the gray level of gray points. According to the schematic illustration showing the statistic numbers in FIG. 8, it is found that the statistic number of the pixels whose gray level variations between the previous frame and the current frame cross the gray level of gray points corresponding to BI is the minimum, wherein BI is the gray point determined according to the combination of FIGS. 4A and 5B. The display effect of the motion picture becomes the best, because the statistic number of pixels whose gray level variations between the previous frame and the current frame cross the gray level of gray point $GP_{Y1}$ is the minimum, wherein the gray point $GP_{Y1}$ is generated by the driving time period assigned to the high-low LUT of FIG. 4A in conjunction with the gray-scale lookup table (High-Low LUT) of FIG. 5B. In addition, a threshold pixel counted value of 81 may be set in advance in order to judge whether the frame is the stationary picture or the motion picture. When all statistic numbers $CN_x$ are smaller than the threshold pixel counted value, it represents that the frame has to be displayed in a stationary manner. At this time, the driving method may be changed to be hold type so that the flicker phenomenon in the stationary display may be further reduced.

In order to achieve the best display effect of the motion picture, the statistic numbers of the pixels whose gray-scale level variations between the previous frame and the current frame cross the gray level of the gray points will be counted. When the minimum statistic number is found, it represents that the best time period assigned to display the pixel data from the gray-scale lookup table (High-Low LUT) and the best gray-scale lookup table (High-Low LUT) are found. The switching of the best time period assigned to display the pixel data from the gray-scale lookup table (High-Low LUT) and the gray-scale lookup table (High-Low LUT) changes the gray level of the pixel. In order to prevent the frame disturbance from being possibly generated, the corresponding drive pixel data during switching may be obtained according to a lookup table which is directly stored in the memory, or may be obtained by way of interpolation between two predetermined lookup tables without creating the additional lookup tables to reduce the usage of the memory.

In the above-mentioned embodiment, the gray point position (gray-scale level) is changed by controlling the time periods for successively displaying the high gray-scale level and the low gray-scale level according to the different scan-line-signal refresh times assigned to the high LUT and the low LUT in conjunction with different high-low LUTs. However, even if the same scan-line-signal refresh time is assigned to the high LUT and the low LUT, the gray point position (gray level) may also be changed by adopting the different gray-scale lookup tables (High-Low LUTs). Thus, when the least statistic number among all the statistic numbers of the pixels whose gray level variations between the two successive frames cross the gray level of the gray points is determined, it represents that the best gray-scale lookup table (High-Low LUT) is found, so that the display quality of the liquid crystal display device is improved, especially motion picture. Besides, even if the same gray-scale lookup table (High-Low LUTs) is taken, the gray point position (gray level) is changed by assigning the different scan-line-signal refresh time to the high LUT and the low LUT. Therefore, when the least statistic number among all the statistic numbers of the pixels whose gray level variations between the two successive frames cross the gray level of the gray points is found, the best scan-line-signal refresh time is determined accordingly to improve the display quality of the liquid crystal device, especially the motion picture.

The above-mentioned method may be applied to an LCD device, which includes a display panel, a timing controller, a data driver and a scan driver. The display panel includes a plurality of pixels, which are respectively electrically connected to scan lines and data lines, and generate a predetermined luminance in a frame time. The timing controller calculates statistic numbers of pixels whose gray level variations between a previous frame and a current frame cross the gray level of the gray point according to at least one scan-line-signal refresh time and at least one gray-scale lookup table, and thus determines the gray-scale lookup table corresponding to a least statistic number among all the statistic numbers. The data driver generates drive pixel data according to the gray-scale lookup table corresponding to the least statistic number so as to output driving voltages of the drive pixel data to the pixels through the data lines. The scan driver outputs scan line signals to the pixels according to the scan-line-signal refresh time corresponding to the least statistic number so as to enable the pixels to receive the driving voltages of the drive pixel data. Thus, the liquid crystal display device can provide the better display quality, especially the motion picture, when the driving method of the invention is adopted.

In summary, the invention discloses a liquid crystal display device and a driving method thereof especially capable of improving the display quality of the motion picture. The statistic numbers of pixels whose gray level variations between a previous frame and a current frame cross the gray level of gray point for each gray point are determined. When a least statistic number is found, it represents that the best gray-scale lookup table (High-Low LUT) and scan-line-signal refresh time are found.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A display device, comprising:

a display panel comprising a plurality of pixels, and scan lines and data lines electrically connected to the pixels;

a timing controller for calculating statistic numbers of pixels whose gray-scale level variations between a previous frame and a current frame cross a gray-scale level of a gray point according to at least one scan-line-signal refresh time and at least one gray-scale lookup table, the timing controller to select a gray-scale lookup table from among plural gray-scale lookup tables corresponding to a lowest statistic number among the statistic numbers; and a data driver for generating pixel data according to the gray-scale lookup table corresponding to the lowest statistic number so as to output driving voltages of the pixel data to the pixels through the data lines;

wherein the scan-line-signal refresh time is an interval time between pixels being successively turned on within a frame;

wherein each statistic number is incremented when a gray-scale level of one of the pixels in an $i^{th}$ row and a $j^{th}$ column in the previous frame is lower than a gray-scale level of the gray point, and a gray-scale level of one of the pixels in the $i^{th}$ row and $j^{th}$ column in the current frame is higher than the gray-scale level of the gray point, or when the gray-scale level of the pixel in the $i^{th}$ row and the $j^{th}$ column in the previous frame is higher than the gray-scale level of the gray point and the gray-scale level of the pixel in the $i^{th}$ row and the $j^{th}$ column in the current frame is lower than the gray-scale level of the gray point.

2. The display device according to claim 1, further comprising a scan driver, wherein the timing controller is to select a scan-line-signal refresh time corresponding to the lowest statistic number among the statistic numbers, and the scan driver is to output scan line signals to the pixels according to the selected scan-line-signal refresh time.

3. The display device according to claim 1, wherein the driving voltages of the pixel data are obtained by looking up a table.

4. The display device according to claim 1, wherein the driving voltages of the drive pixel data are obtained by way of interpolation.

5. A method of driving a display device, comprising:

setting at least one scan-line-signal refresh time;

setting at least one gray-scale lookup table;

generating at least two gray points according to the scan-line-signal refresh time and the gray-scale lookup table;

calculating statistic numbers of pixels whose gray-scale level variations between a previous frame and a current frame cross a gray-scale level of the gray points;

identifying a gray-scale lookup table corresponding to a lowest statistic number among statistic numbers; and generating pixel data according to the gray-scale lookup table corresponding to the lowest statistic number, and outputting driving voltages of the drive pixel data to the pixels of the display device;

wherein the scan-line-signal refresh time is an interval time between pixels being successively turned on within a frame; and incrementing each the statistic number when a gray-scale level of one of the pixels in an $i^{th}$ row and a $j^{th}$ column in the previous frame is lower than a gray-scale level of the corresponding gray point and a gray-scale level of one of the pixels in an $i^{th}$ row and a $j^{th}$ column in the current frame is higher than the gray-scale level of the corresponding gray point, or when the gray-scale level of the pixel in the $i^{th}$ row and the $j^{th}$ column in the previous frame is higher than the gray-scale level of the corresponding gray point and the gray-scale level of the pixel in the $i^{th}$ row and the $j^{th}$ column in the current frame is lower than the gray-scale level of the corresponding gray point.

6. The method according to claim 5, further comprising:

identifying the scan-line-signal refresh time corresponding to the lowest statistic number; and outputting scan line signals to the pixels of the display device according to the scan-line-signal refresh time corresponding to the lowest statistic number so as to enable the pixels to receive the driving voltages of the pixel data.

7. The method according to claim 5, wherein the driving voltages of the pixel data are obtained by looking up a table.

8. The method according to claim 5, wherein the driving voltages of the pixel data are obtained by way of interpolation.

9. A display device, comprising:

a display panel comprising a plurality of pixels, and scan lines and data lines electrically connected to the pixels;

a timing controller to calculate statistic numbers of pixels whose gray-scale level variations between a previous frame and a current frame cross a gray-scale level of a gray point according to at least one scan-line-signal refresh time and at least one gray-scale lookup table, and to select a scan-line-signal refresh time corresponding to a lowest statistic number among all the statistic numbers; and a scan driver for outputting scan line signals to the pixels according to the scan-line-signal refresh time corresponding to the lowest statistic number so as to enable the pixels;

wherein the scan-line-signal refresh time is an interval time between pixels being successively turned on within a frame;

wherein each statistic number is incremented when a gray-scale level of one of the pixels in an $i^{th}$ row and a $j^{th}$ column in the previous frame is lower than a gray-scale level of the gray point and a gray-scale level of one of the pixels in an $i^{th}$ row and a $j^{th}$ column in the current frame is higher than the gray-scale level of the gray point, or when the gray-scale level of the pixel in the $i^{th}$ row and the $j^{th}$ column in the previous frame is higher than the gray-scale-scale level of the gray point and the gray-scale level of the pixel in the $i^{th}$ row and the $j^{th}$ column in the current frame is lower than the gray-scale level of the gray point.

10. The display device according to claim 9, further comprising a data driver, wherein the timing controller is to select one of plural gray-scale lookup table corresponding to the lowest statistic number, and the data driver is to generate pixel data according to the gray-scale lookup table corresponding to the lowest statistic number so as to output driving voltages of the drive pixel data to the pixels through the data line.

11. The display device according to claim 10, wherein the driving voltages of the pixel data are obtained by looking up a table.

12. The display device according to claim 10, wherein driving voltages of the pixel data are obtained by way of interpolation.

13. A method of driving a display device, comprising the steps of:

setting at least one scan-line-signal refresh time;

setting at least one gray-scale lookup table;

generating at least two gray points according to the scan-line-signal refresh time and the gray-scale lookup table;

calculating statistic numbers of pixels whose gray-scale level variations between a previous frame and a current frame cross a gray-scale level of the gray points;

identifying a scan-line-signal refresh time from among plural scan-line refresh times corresponding to a lowest statistic number among the statistic numbers;

outputting scan line signals to the pixels of the display device according to the identified scan-line-signal refresh time corresponding to the lowest statistic number so as to enable the pixels;

wherein the scan-line-signal refresh time is an interval time between pixels being successively turned on within a frame; and incrementing each statistic number when a gray-scale level of one of the pixels in an $i^{th}$ row and a $j^{th}$ column in the previous frame is lower than a gray-scale level of the corresponding gray point and a gray-scale level of one of the pixels in an $i^{th}$ row and a $j^{th}$ column in the current frame is higher than the gray-scale level of the corresponding gray point, or when the gray-scale level of the pixel in the $i^{th}$ row and the $j^{th}$ column in the previous frame is higher than the gray-scale level of the corresponding gray point and the gray-scale level of the pixel in the $i^{th}$ row and the $j^{th}$ th column in the current frame is lower than the gray-scale level of the corresponding gray point.

14. The method according to claim 13, further comprising:

calculating the statistic numbers of the pixels whose gray-scale level variations between the previous frame and the current frame cross the gray-scale level of the gray points, and determining the gray-scale lookup table corresponding to the least statistic number; and generating drive pixel data according to the gray-scale lookup table corresponding to the least statistic number, and outputting driving voltages of the drive pixel data to the pixels of the display device.

15. The method according to claim 14, wherein the driving voltages of the pixel data are obtained by looking up a table.

16. The method according to claim 14, wherein the driving voltages of the pixel data are obtained by way of interpolation.

* * * * *